US005244362A

United States Patent [19]

Conally

[11] Patent Number: 5,244,362

[45] Date of Patent: Sep. 14, 1993

[54] CHEMICAL INJECTOR SYSTEM FOR HYDROCARBON WELLS

[75] Inventor: Harlew Conally, Robstown, Tex.

[73] Assignee: TXAM Chemical Pumps, Inc., Robstown, Tex.

[21] Appl. No.: 930,812

[22] Filed: Aug. 17, 1992

[51] Int. Cl.[5] ..... F04B 9/08

[52] U.S. Cl. ..... 417/403; 166/64

[58] Field of Search ..... 417/403, 401; 166/53, 166/64

[56] References Cited

U.S. PATENT DOCUMENTS

| | | | |
|---|---|---|---|
| Re. 32,304 | 12/1986 | Maxwell | 166/64 X |
| 3,901,313 | 8/1975 | Doniguian et al. | 166/64 |
| 4,132,268 | 1/1979 | Harrison | 166/64 X |
| 4,776,775 | 10/1988 | Conally | 417/401 |

FOREIGN PATENT DOCUMENTS

| | | | |
|---|---|---|---|
| 610778 | 12/1960 | Canada | 417/403 |
| 2037880 | 7/1980 | United Kingdom | 417/403 |

*Primary Examiner*—Leonard E. Smith
*Attorney, Agent, or Firm*—G. Turner Moller

[57] ABSTRACT

A chemical injector system for wells includes a solenoid operated valve delivering bursts of supply gas to a piston driven chemical injector pump. The solenoid valve allows very low cycle rates and also avoids plugging up of the gas supply line because the bursts of supply gas create high enough velocities to keep water and debris moving. A stand having a spike and a plate welded thereto supports the injector pump.

19 Claims, 2 Drawing Sheets

CHEMICAL INJECTOR SYSTEM FOR HYDROCARBON WELLS

This invention relates to a system for injecting chemicals into hydrocarbon producing wells and flow lines.

Many common situations exist in oil or gas fields where it is necessary or desirable to inject a chemical into a well or into a flow line leading from a well to accomplish some purpose. For example, it is often desirable to inject methanol into the flow lines of high pressure gas wells to prevent gas hydrate formation downstream of the choke. It is also often desirable to inject corrosion inhibitor into a well or into a flow line to retard corrosion. The sale of oil field chemicals is a big business and much of the chemical is applied by injecting it with a small chemical injector pump. The development of chemical injector pumps has proceeded for many years and current pumps are the result of a long evolution.

Standard chemical injector pumps comprise a piston-cylinder arrangement in which gas available from a well is periodically delivered to the piston although sometimes a liquid is used. A piston rod extends out of the cylinder and connects with a plunger in a pump chamber equipped with inlet and exhaust check valves. When the piston rod and plunger retract, chemical flows into the pump chamber. When the piston rod and plunger extend, the inlet check valve closes and chemical is pumped to its use site.

The amount of chemical being injected is very small and well operators interested in the costs of operation always desire small dose chemical treatments. It is not uncommon that chemical injection be required substantially continuously but in such small doses that a 55 gallon drum will last a month or so. To meet this requirement of small quantity injector pumps, two major developments occurred long ago. First, oil field type chemical injector pumps are physically quite small, e.g. one standard size is $\frac{1}{4}''$ bore $\times \frac{3}{4}''$ stroke which delivers 0.0117 cubic inches of liquid chemical per cycle. Second, means have been developed to actuate the pump periodically, e.g. 1–20 cycles per minute, rather than continuously.

Standard chemical injector pumps use an accumulator type valve to control the rate of pumping. The valves are connected by a small flow line to a well conduit and are usually gas operated but are sometime liquid operated from well fluids. A needle valve controls the flow rate to the accumulator valve. When a predetermined quantity of gas or liquid is received by the accumulator type valve, the valve opens to deliver well products to the piston, thereby extending the piston rod and pumping chemical toward the use site. When the piston has reached its limit of travel, the accumulator valve closes and thereby exhausts the cylinder to the atmosphere and the piston retracts, either with a spring or by applying pressure to the opposite side of the piston. When one desires to slow the pump down, the needle valve is closed slightly to reduce the gas flow rate into the accumulator valve.

There are several problems with chemical injector systems that are cycled by conventional accumulator type valves. First, as the cycle rate decreases, there comes a point in any installation where the system fails. Oil or gas wells are not tended continuously so this is observed when the gauger comes to the well, usually once a day but often less frequently, e.g. once a week.

The gauger will notice the chemical pump is stuck and has to get it working again. If this occurs often, the cycle rate has to be increased by cracking the needle valve slightly more to deliver gas at a higher rate to the pump. This obviously causes overdosing of the situation and is commonly done simply to keep the pump running. One small oil company estimates that in excess of fifteen percent of the $400,000 worth of chemical it buys in a year is overdosed merely to keep injector pumps running.

Commercially available chemical injector pumps are made by companies such as Texstream, Williams, Linc and Western. Disclosures of some interest relative to this invention are found in U.S. Pat. Nos. 3,901,313; 4,132,268; 4,776,775 and RE 32,304.

This invention incorporates a more-or-less conventional gas or liquid operated piston and pump assembly. Means are provided to purge the supply line periodically by providing a burst or pulse of the power gas or liquid. In one embodiment, a solenoid operated supply and exhaust valve is connected to a source of gas or liquid, usually well products. The solenoid valve is cycled by a battery operated controller and is capable of very low cycle rates, e.g. 1 or 2 per minute, without experiencing the sticking commonly associated with conventional accumulator type valves operating at low cycle rates. The solenoid valve acts to open the supply line for a predetermined interval and then exhausts to allow the piston to retract, either under the influence of a spring or by pressure. Because the solenoid valve opens fully when it opens, a pulse of supply gas passes through the supply line to keep the supply line clear of water, hydrates or debris.

In another embodiment, a conventional accumulating type actuating valve and manual throttling valve are provided. A purge valve connected to the supply line between the throttling valve and actuating valve is periodically opened to exhaust supply gas to the atmosphere and thereby purge the supply line to keep it clear of water, hydrates or debris.

It is an object of this invention to provide an improved chemical injector system.

Another object of this invention is to provide an improved chemical injector system in which supply fluid is periodically rapidly delivered through the supply line.

A more specific object of this invention is to provide an improved chemical injector pump having a solenoid operated supply and exhaust valve capable of very low cycle rates.

Another more specific object of this invention is to provide an improved chemical injector pump in which the supply line is periodically purged.

These and other objects of this invention will become more fully apparent as this description proceeds, reference being made to the accompanying drawings and appended claims.

IN THE DRAWINGS

Figures 1, 2, 3, 5:
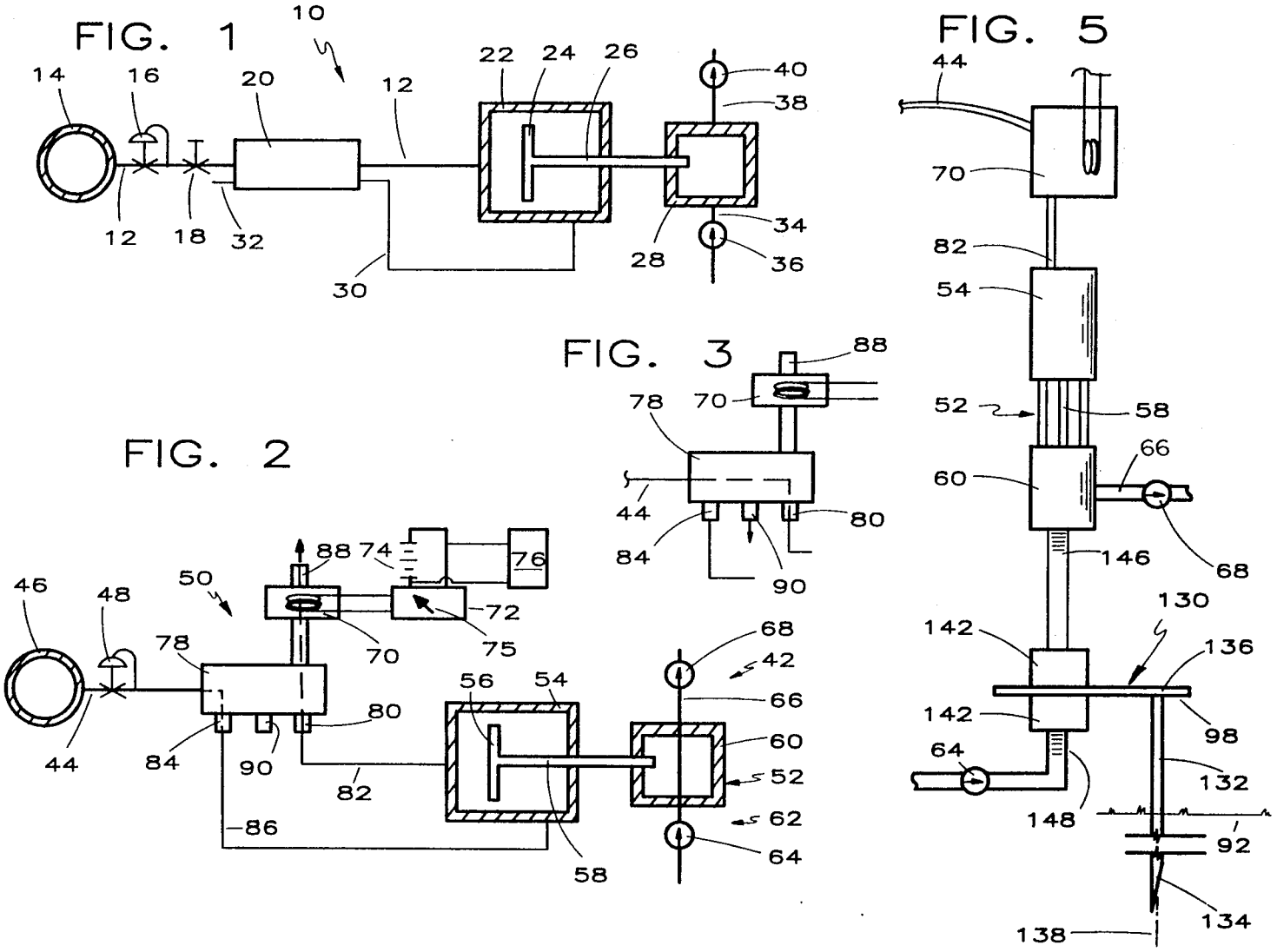
FIG. 1 is a schematic view of a conventional gas operated chemical injector system.
FIG. 2 is a schematic view of a chemical injector system of this invention showing a solenoid operated supply and exhaust valve in its deenergized position.
FIG. 3 is a schematic view of the solenoid valve of FIG. 2 in its energized position.
FIG. 5 is a view of a stand of this invention used to support a chemical injector pump.

Referring to FIG. 1, a conventional chemical injector installation 10 includes a supply line 12 connected to a well flow line 14 through a pressure regulator 16. Typically, the supply line is ¼–½" O.D. The well flow line 14 may contain any fluid, by which is meant gas, liquid or a mixture thereof. In a typical gas well, the flow line 14 may be operating at 1,000 psig and the regulator 16 throttles the working pressure of the injector pump to 50–80 psig. A manual throttling valve 18, usually a needle valve, limits the volume of gas flowing in the supply line 12 to an actuating valve 20. When the actuating valve 20 fills up and opens, supply gas passes through the supply line 12 to a cylinder 22 driving a piston 24 and pushing a piston rod or plunger 26 into a pump cylinder 28 while the opposite side of the piston 24 is exhausted through lines 30, 32. A pump inlet 34 includes a check valve 36 and a pump outlet 38 includes a check valve 40. To reduce the cycle rate of the piston 24, the needle valve 18 is pinched down. To increase the cycle rate of the piston 24, the needle valve 18 is opened slightly. The piston 2 is retracted either with a spring (not shown) or by the application of supply gas on the opposite side of the piston 24. This may occur by selecting an accumulator valve 20 having the capability of connecting the upstream supply line 12 to the line 30 and connecting the downstream supply line 12 to the line 32.

When the manual throttling valve 18 is pinched down enough to give a very low cycle rate, e.g. 1–3 strokes per minute, all known chemical injector systems of this type work for a few hours or a few days and then quit. When the gauger or chemical supplier investigates why, about 90% of the failures are because the flow line 12 is frozen up, plugged up or full of water between the needle valve 18 and the actuating valve 20. The remainder fail because the actuating valve 20 is corroded by water or plugged up with debris or water. The presence of water in the supply line 12 is not surprising because the flow line 14 is immediately downstream of the well and upstream of a gas dehydration facility, which may be a long way off.

On reflection, it will be seen that water, gas hydrates or debris collects between the needle valve 18 and the actuating valve 20 at very low cycle rates because the rate of gas flow is very low and obviously gets low enough that liquid and solid particles collect rather than move along. In contrast, flow between the actuating valve 20 and the pump cylinder 22 is sporadic but fast enough when it does occur to keep particles moving to ultimately exhaust from the cylinder 22. Thus, the reason that most of the failures are caused by plugging between the throttling valve 18 and the accumulator valve 20 are caused by the very low flow rates between these components at low cycle rates.

Referring to FIGS. 2–3, the chemical injector system 42 of this invention includes a supply line 44 connected to a well flow line 46 through a pressure regulator 48. A solenoid operated supply and exhaust valve 50 is provided to deliver power gas to a more-or-less conventional pump 52 including a cylinder 54 and a piston 56 therein driving a piston rod or plunger 58 for extending and retracting movement in a pump cylinder 60. The pump cylinder 60 includes an inlet 62 having a check valve 64 therein and an outlet 66 having a check valve 68 therein. The solenoid valve 50 delivers power gas to the cylinder 54 when a solenoid operator 70 is energized by a settable controller 72 energized by a battery 74 which is preferably recharged during sunlight hours by a solar panel 76.

The controller 72 is capable of energizing the solenoid operator 70 at any desired rate which establishes the cycle rate of the pump 52 in any suitable range, such as 1 cycle per month–30 cycles per minute. The controller 72 is accordingly a timer settable in some fashion, as by the provision of a knob or counter 75. In a preferred embodiment, the solenoid valve 50 is momentarily more-or-less fully opened to provide a burst of supply gas which is sufficient to purge the power gas supply lines upstream and downstream of the valve 50. In a typical installation, the valve 50 may be open for one second or less, and usually is open for only one-half second. This is in contrast to the prior art devices in which the flow of supply gas is more-or-less continuous when the cycle rate is high enough to keep the flow line 12 clear between the needle valve 18 and the actuating valve 20.

In this fashion, the pulses of supply gas in this invention create flow velocities sufficiently high that water, gas hydrates and debris are moved through the system and do not accumulate to plug up the gas supply line 44. It has been found that when the average periodic velocity in the supply line 44 exceeds ten feet/second, there is no water, hydrate or debris build up. When the average periodic velocity in the supply line 44 falls below five feet/second, water, hydrates or debris eventually collect causing the supply line to plug up. Average periodic velocity means the average velocity in the supply line during the period in which the valve is open. Thus, in this invention, the average periodic velocity in the supply line 44 is selected to be above five feet/-second and preferably above ten feet/second.

The piston 56 may be returned to its retracted position by a spring (not shown) but is preferably retracted with power gas. To this end, the solenoid valve 50 preferably comprises an inlet end 78 connected to the supply line 44, a first outlet fitting 80 connected to one end of the cylinder 54 by a flow line 82, a second outlet fitting 84 connected to the opposite end of the cylinder 54 by a flow line 86 and first and second exhaust fittings 88, 90.

Thus, in a preferably deenergized condition of the solenoid operator 70, the flow path through the valve 50 is as shown in FIG. 2 where high pressure gas passes through the outlet fitting 84 and flow line 86 to the cylinder 54 to retract the piston 5 while the opposite side of the piston 5 is exhausted through the flow line 82, the outlet fitting 80 and the exhaust fitting 88. When the solenoid operator 70 is energized by the controller 72, the flow path through the valve 50 changes as shown in FIG. 3 where high pressure gas passes through the outlet fitting 80 and flow line 82 to the cylinder 54 while the opposite side of the piston 56 is exhausted through the flow line 86, outlet fitting 84 and exhaust fitting 90.

Although any suitable solenoid operated supply and exhaust valve can be made to work in this invention, a particularly suitable device is made by Automatic Switch Company, Florham Park, N.J. and is known as a two position, four way solenoid valve, midget size, ¼ npt as explained in bulletin 8345 to which reference is made for a more complete description. Although the controller 72 may be of any suitable type, a particularly suitable device is known as a programmable, digital time delay relay and one such device is made by Potter & Brumfield, Princeton, Ind. and is known as a CNT-35-26. In the event a more complete description is needed, reference is made to publications of Potter & Brumfield.

A major effect of the solenoid valve 50 is to eliminate the manual throttling valve and thereby eliminate the cause of most chemical injector failures which occur during low cycle rates. Instead of having very low flow rates in part of the gas supply line 44, bursts or pulses of gas flow are at a rate sufficiently high to keep liquid droplets or solid particles moving in the line 44. In a typical prior art device, the velocity of power fluid in the supply line 12 between the throttling valve 18 and the actuating valve 20 is very low at low cycle rates, such as less than one foot/second at flow rates of one per minute.

Figure 4:
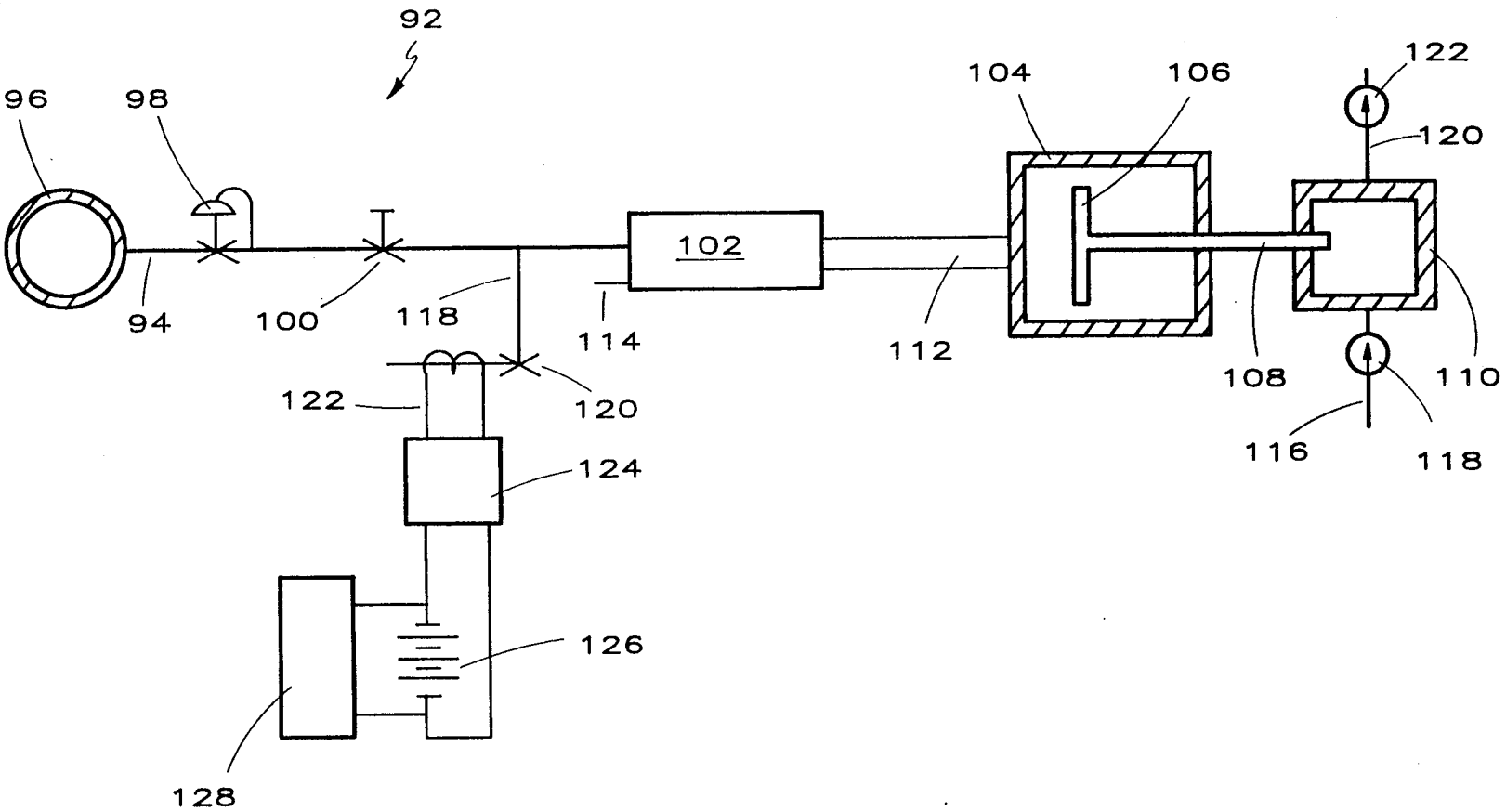
FIG. 4 is a schematic view of a chemical injector system of this invention showing a solenoid operated purge valve.

Referring to FIG. 4, another embodiment of the chemical injector system 92 of this invention is illustrated. The system 92 is very similar to the conventional chemical injector installation 10 of FIG. 1 and includes a supply line 94 connected to a well flow line 96 through a pressure regulator 98. The well flow line 96 may contain any fluid, by which is meant gas, liquid or a mixture thereof. In a typical gas well, the flow line 96 may be operating at 1,000 psig and the regulator 98 throttles the working pressure of the injector pump to 50–80 psig. A manual throttling valve 100, usually a needle valve, limits the volume of gas flowing in the supply line 94 to a actuating valve 102. The actuating valve 102 is of the accumulating type and, when it fills up and opens, supply gas passes through the supply line 94 to a cylinder 104 driving a piston 106 and pushing a piston rod or plunger 108 into a pump cylinder 110 while the opposite side of the piston 106 exhausts through lines 112, 114. A pump inlet 116 includes a check valve 118 and a pump outlet 120 includes a check valve 122. To reduce the cycle rate of the piston 106, the needle valve 100 is pinched down. To increase the cycle rate of the piston 106, the needle valve 100 is opened slightly. The piston 106 is retracted either with a spring (not shown) or by the application of supply gas on the opposite side of the piston 106. This may occur by selecting an accumulator valve 102 having the capability of connecting the upstream supply line 94 to the line 112 and connecting the downstream supply line 12 to the line 114.

To periodically purge the flow line segment 116 between the throttling valve 100 and the actuating valve 102, a fitting 118 is provided having a solenoid operated valve 120 open to the atmosphere. A solenoid operating coil 122 is electrically connected to a controller 124 for periodically energizing the coil 122 and thereby opening the valve 120. A battery 126 operates the controller 124 and coil 122 and is kept charged by a solar panel 128.

The solenoid valve 120 and controller 124 are selected to open the valve 120 periodically and keep the valve 120 open for a short period of time, e.g. fifteen seconds, which is sufficient to purge the flow line segment 116 by exhausting power gas at a velocity greater than ten feet/second during the period the valve 120 is open. This is normally sufficient to exhaust any water, hydrates or debris to the atmosphere and prevent the flow line segment 116 from plugging up. The controller 124 may be set to open the valve 120 in any suitable cycle, e.g. once an hour or once a day.

Referring to FIG. 5, a convenient technique for supporting the pump 52 and solenoid valve 50 is illustrated. A support 130 comprises an elongate spike 132 having a sharp point 134 at one end and a plate 136 welded or otherwise secured to the other end. The spike 132 can easily be driven into the ground simply by stepping on the plate 136. The plate 136 is offset to the axis 13 of the spike 132 providing an opening 140 therethrough. A pair of threaded nuts 142, 144 are welded to the plate 136 concentric with the opening 140. The inlet 62 of the pump cylinder 60 is provided with a nipple 146 integral with the cylinder 60 threaded into the nut 104 and a nipple 148 threaded into the nut 144.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A chemical injector system for connection to a pressure regulated fluid supply, comprising a motor cylinder having a piston movable therein in a cycle including an extension and a retraction, a pump cylinder having a plunger connected to the piston, an inlet including a check valve therein for connection to a source of chemical to be pumped, an outlet including a check valve therein for connection to a line leading to a use site, and power fluid supply means for connection to the fluid supply for intermittently delivering pressurized fluid from the fluid supply to the motor cylinder for extending the piston including an intermittently opened solenoid operated valve means, and a settable electronic timer for adjusting the frequency of opening of the valve means for cycling the piston in a range including 1–3 cycles per minute.

2. A chemical injector system for connection to a pressure regulated fluid supply, comprising a motor cylinder having a piston movable therein in a cycle including an extension and a retraction, a pump cylinder having a plunger connected to the piston, an inlet including a check valve therein for connection to a source of chemical to be pumped, an outlet including a check valve therein for connection to a line leading to a use site, power fluid supply means for connection to the fluid supply for intermittently delivering pressurized fluid from the fluid supply to the motor cylinder for extending the piston including an intermittently opened solenoid operated valve means, means for adjusting the frequency of opening of the valve means for cycling the piston in a range including 1–3 cycles per minute, and means providing pulses of fluid flow throughout the power fluid supply means at a velocity of at least five feet per second during a period when the solenoid valve is open.

3. The chemical injector system of claim 2 wherein the solenoid operated valve provides an inlet for connection to the fluid supply, and an outlet, a first conduit connected to the pump cylinder on a first side of the piston, an exhaust outlet opening to the atmosphere and means alternatively connecting the conduit to the outlet and to the exhaust outlet.

4. The chemical injector system of claim 2 wherein the pressure regulated fluid supply comprises a pressure regulator and further comprising a conduit connected to the solenoid valve for connection to the pressure regulator, the means providing pulses of fluid flow comprising means providing pulses of fluid flow through the conduit at a velocity of at least ten feet per second during a period when the solenoid valve is open.

5. A method of injecting liquid chemicals to a use site, comprising passing process fluid through a pressure regulator and reducing the pressure thereof, intermittently delivering pressure reduced process fluid through a valve to a motor cylinder having a piston therein for extending the piston, extending a plunger, connected to the piston, into a chamber having the liquid chemical therein and pumping the liquid chemical toward the use site and then retracting the plunger, and delivering pulses of process fluid between the pressure regulator and the valve at a velocity of at least ten feet/second.

6. The process of claim 5 wherein the pulses of process fluid are delivered to the motor cylinder.

7. The process of claim 5 wherein the pulses of process fluid are exhausted to the atmosphere.

8. The process of claim 5 wherein the process fluid is selected from the group consisting essentially of a gas, a liquid and mixtures thereof.

9. The process of claim 5 wherein the process fluid is a mixture of gas and liquid.

10. A chemical injector system for connection to a fluid supply, comprising a motor cylinder having a piston movable therein in a cycle including an extension and a retraction, a pump cylinder having a plunger connected to the piston, an inlet including a check valve therein for connection to a source of chemical to be pumped, an outlet including a check valve therein for connection to a line leading to a use site, power fluid supply means for connection to the fluid supply for intermittently delivering pressurized fluid from the fluid supply to the motor cylinder for extending the piston including means providing pulses of fluid flow throughout the power fluid supply means at a velocity of at least five feet per second, the pulse providing means including an intermittently opened valve means and means for adjusting the frequency of opening of the valve means for cycling the piston in a range including 1-3 cycles per minute.

11. The chemical injector system of claim 10 wherein the velocity is at least ten feet per second.

12. The chemical injector system of claim 10 wherein the means providing pulses of fluid flow throughout the power fluid supply means comprises means providing pulses of fluid flow through the power fluid supply means at a velocity of at least five feet per second throughout the frequency range.

13. The chemical injector system of claim 10 wherein the means for adjusting the frequency of opening of the valve means includes a settable electronic timer.

14. The chemical injector system of claim 10 further comprising a conduit section connected to the intermittently opened valve means and extending in an upstream direction, and wherein the intermittently opened valve means comprises a normally closed accumulating valve and means for opening the valve upon collection of a predetermined quantity of fluid, the means for adjusting the frequency of opening of the valve means comprises a manually operated throttling valve in the conduit section, and the means providing pulses of fluid flow throughout the power fluid supply means at a velocity of at least five feet per second comprises second valve means for purging the conduit section.

15. The chemical injector system of claim 14 wherein the second valve means comprises a solenoid operated valve.

16. The chemical injector system of claim 10 wherein the means providing pulses comprises means providing pulses of fluid flow throughout the power fluid supply means at a velocity of at least ten feet per second during the period when the valve means opens.

17. The chemical injector system of claim 16 wherein the intermittently opened valve means includes a solenoid operated valve having an inlet for connection to the pressure regulated fluid supply, and an outlet, a first conduit connected to the pump cylinder on a first side of the piston, an exhaust outlet opening to the atmosphere and means alternatively connecting the conduit to the outlet and to the exhaust outlet.

18. The chemical injector system of claim 17 wherein the solenoid valve provides a second conduit connected to the pump cylinder on a second side of the piston and the alternatively connecting means comprises means connecting the outlet to the first conduit and the exhaust outlet to the second conduit and then connecting the outlet to the second conduit and the exhaust outlet to the first conduit.

19. The chemical injector system of claim 17 wherein the power fluid supply means comprises a pressure regulator upstream of the solenoid valve, the means providing fluid flow throughout the power fluid supply means at a velocity of at least five feet per second comprising means providing fluid flow at a velocity of at least five feet per second between the pressure regulator and the solenoid valve.

* * * * *